US006520714B1

(12) United States Patent
Marsik, Jr.

(10) Patent No.: US 6,520,714 B1
(45) Date of Patent: Feb. 18, 2003

(54) TRANSITION SURFACE FOR ROADWAY

(76) Inventor: Jerrold L. Marsik, Jr., 1850 Marsik La., Jacksonville, IL (US) 62650

( * ) Notice: Subject to any disclaimer, the term of this patent is extended or adjusted under 35 U.S.C. 154(b) by 0 days.

(21) Appl. No.: 09/924,520

(22) Filed: Aug. 9, 2001

(51) Int. Cl.[7] ..... E01C 5/00; E01C 5/20
(52) U.S. Cl. ..... 404/35; 238/12
(58) Field of Search ..... 14/69.5; 238/8, 238/12; 404/9, 15, 35, 39

(56) References Cited

U.S. PATENT DOCUMENTS

| | | | | | |
|---|---|---|---|---|---|
| 1,055,442 | A | * | 3/1913 | Browne | 238/8 |
| 1,611,660 | A | * | 12/1926 | Manly | 473/159 |
| 1,658,444 | A | * | 2/1928 | King | 238/8 |
| 3,607,592 | A | * | 9/1971 | Jenkins | 14/2.4 |
| 4,176,789 | A | * | 12/1979 | Rich | 238/6 |
| 4,300,721 | A | * | 11/1981 | Rich | 104/133 |
| 4,808,025 | A | * | 2/1989 | McGinnis | 404/26 |
| 4,899,932 | A | * | 2/1990 | Beachy et al. | 238/8 |
| 4,917,531 | A | | 4/1990 | McGinnis | 404/26 |
| 5,201,467 | A | | 4/1993 | Kennel et al. | 238/8 |
| 5,281,046 | A | | 1/1994 | Svirklye | 404/26 |
| 5,308,188 | A | * | 5/1994 | Shaftner | 404/25 |
| 5,483,715 | A | * | 1/1996 | Fogarty et al. | 14/69.5 |
| 5,536,110 | A | | 7/1996 | Tompkins et al. | 404/25 |
| 5,595,455 | A | | 1/1997 | Svirklys | 404/25 |
| 5,598,594 | A | * | 2/1997 | Milliken et al. | 14/69.5 |
| 5,653,551 | A | * | 8/1997 | Seaux | 404/35 |
| 5,775,835 | A | * | 7/1998 | Szekely | 104/30 |
| 5,813,602 | A | * | 9/1998 | Holland | 238/8 |
| 5,888,612 | A | * | 3/1999 | Needham et al. | 428/116 |

* cited by examiner

*Primary Examiner*—Gary S. Hartmann
(74) *Attorney, Agent, or Firm*—Patent & Trademark Services; Thomas Zack; Joseph H. McGlynn

(57) ABSTRACT

A transition device for roadways having hardened steel metal edges and a fill material with a honeycomb structure and rebars adjacent the fill material.

5 Claims, 4 Drawing Sheets

TRANSITION SURFACE FOR ROADWAY

BACKGROUND OF THE INVENTION

This invention relates to a transition device for roadways, manhole covers and other structures commonly found in roadways.

Transition devices are used in roadways when repairs or road construction takes place. One common way to make a transition device is to construct a temporary slope with asphalt or another paving material on the sides of the object over which a vehicle moves. After the work has been completed, the material is removed and discarded. With this type of transition construction applying and then removing the paving material is a time consuming and an expensive task. To lessen the costs and efforts required temporary transition devices have been developed. Temporary transition devices are those which are intended for temporary use and which can be reused. As with paving materials, these devices provide for a smooth and bump-free transition on the roadway as a vehicle passes over them.

DESCRIPTION OF THE PRIOR ART

Transition devices that are intended for use in roadways are known in the prior art. For example, U.S. Pat. No. 4,917,531 to McGinnis discloses a temporary device for street repair which provides a ramp with clips to hold the ramp in place.

U.S. Pat. No. 5,201,467 to Kennel et al. discloses a railroad grade crossing which has a plurality of pieces which have rods to join the pieces together.

U.S. Pat. No. 5,281,046 to Svirklye discloses a resilient transition collar for roadway structures.

U.S. Pat. No. 5,536,110 to Tompkins et al. discloses a transition collar for road construction with horizontally spaced ridges thereon.

U.S. Pat. No. 5,595,455 to Svirklys discloses a resilient transition collar for roadway structures.

The present invention is directed to a transition device for a roadway having a ramp with hardened steel metal edges and a honeycomb structure with rebars(reinforcing bars) embedded all as will be detailed in the specification that follows hereafter.

SUMMARY OF THE INVENTION

This invention relates to a transition device for roadways having hardened steel metal edges and a honeycomb structure with rebars(reinforcing bars) embedded.

It is the primary object of the present invention to provide for an improved transition device for use in roadways.

Another object is to provide for such a device in which edges are constructed of hardened metal and there is a honeycombed structure with embedded rebars.

These and other objects and advantages of the present invention will become apparent to readers from a consideration of the ensuing description and the accompanying drawings.

BRIEF DESCRIPTION OF THE DRAWINGS

FIG. 2(*b*) is a cross sectional view of a cylinder mounted in the transition device.

FIG. 3(*b*) is a top view of three of the honeycombed structures used for fill material.

FIG. 6(*b*) is a side cross section view of the FIG. 1 embodiment showing the transition device on a roadway bump.

DESCRIPTION OF THE PREFERRED EMBODIMENT

Figure 1:
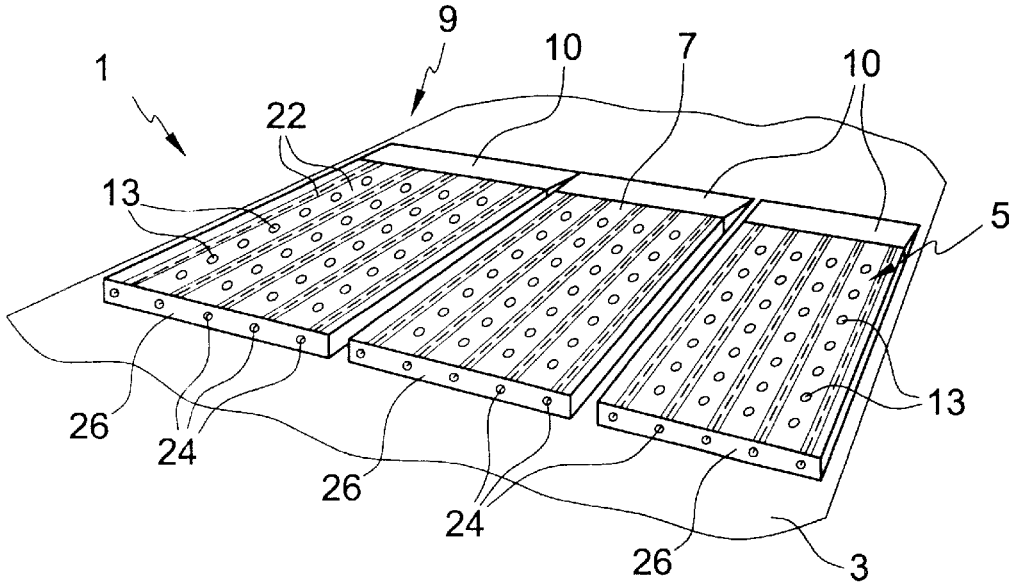
FIG. 1 is a perspective view of the present invention on a roadway.

FIG. 1 is a perspective view of the present invention 1 applied on a roadway 3. The transition device 1 consists of ramp sections 5,7, 9 which typically fits over a section of roadway 3 that is undergoing repair or construction. Each ramp section has the same internal construction as will be described. The forward ramp section edges 10 are made of a hardened steel metal strips. Mounted in spaced rows in each ramp section are vertical cylinders 13, whose tops are exposed as shown in FIG. 1. The cylinder tops are slightly elevated with respect to the top surface of the ramp sections 5,7, 9. Fill material 22, between the cylinders 13, forms most of the surface of the transition device 1 (see FIG. 4). The fill material 22 is made in a honeycombed (hexagonal in cross section) units made of a material such as harden rubber, from recycled tires. The upper ramp surface formed by the exposed fill material 22 and the tops of cylinders 13 forms the surface of the ramp sections 5,7, 9 on which vehicle tires move. The ramp surface may be generally horizontal, as shown in FIG. 1, or may be inclined, as shown in the FIGS. 5 and 6(*a*).

Figure 4:
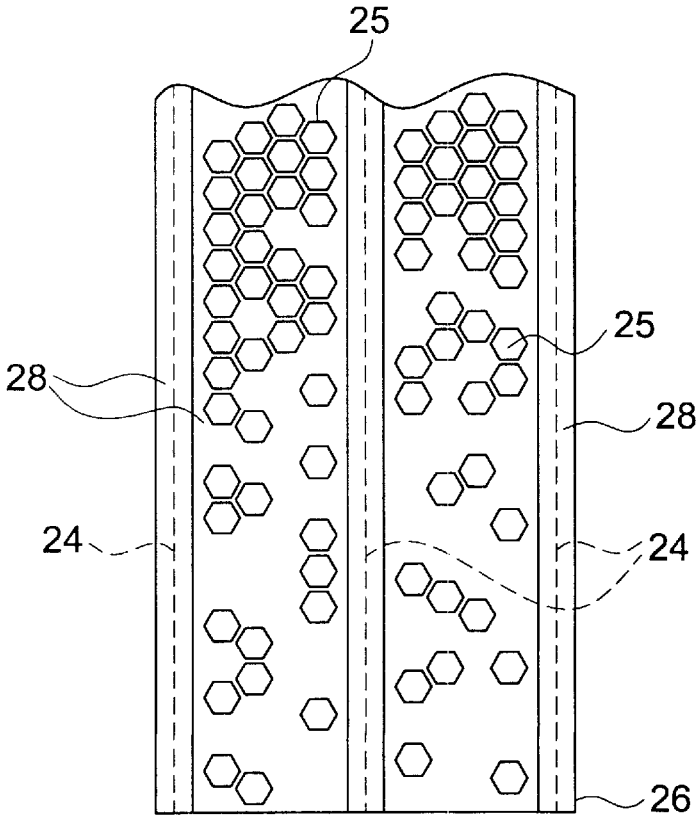
FIG. 4 is another top view showing the rebars and honeycombed structures of the transition device.

Extending the length of each ramp section 5,7, 9 are metal reinforcing bars or rebars 24 (see FIG. 4). The rebars 24 are spaced from each other and generally parallel to each other. They extend substantially the entire length of each ramp section. The rebars are inserted into sleeves that fit in holes in the thicker ramp ends 26. The rebars 24 are shown as dotted lines in the fill material 22.

Figure 2A:
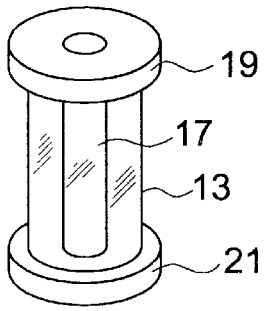
FIG. 2(*a*) is a perspective view of one of the cylinders used in the FIG. 1 embodiment.
Figure 2B:
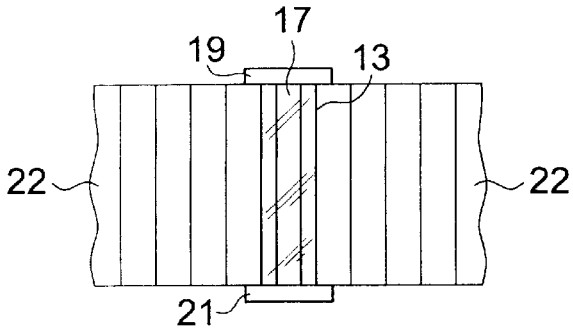

FIG. 2(*a*) is a perspective view of one of the cylinders 13 used in the FIG. 1 embodiment. In this view cylinder 13 is shown as made with a clear material, although other materials could be used without departing from the scope of the invention. Within the cylinder 13 is a vertically disposed inner cylinder 17 through which a lag bolt can be inserted to secure the cylinder 13 to the roadway 3. Top 19 and bottom 21 washers fit over the ends of cylinder 13 and mount the inner cylinder 17. The lower end of a lag bolt (not shown, see FIG. 7) extends below the cylinders 13 and 17 to allow attachment to the underlining roadway 3.

FIG. 2(*b*) is a cross sectional view of a cylinder 13 as mounted in the transition device 1. The top and bottom washers 19,21 fit over the top and bottom surfaces, respectively, of the fill material 22. The cylinder 17 is centered within the cylinder 13 with opened top and bottom ends for the lag bolt to be inserted in it. The purpose of the cylinder 13 is to prevent the fill material 22, making up most of the transition device, from crushing when the load of a vehicle presses down. The cylinders 13 are made of a strong and not easily compressed material, such as metal or a plastic material like ABS Acrylonitrile-butadiene-styrene) plastic.

Figure 3A:
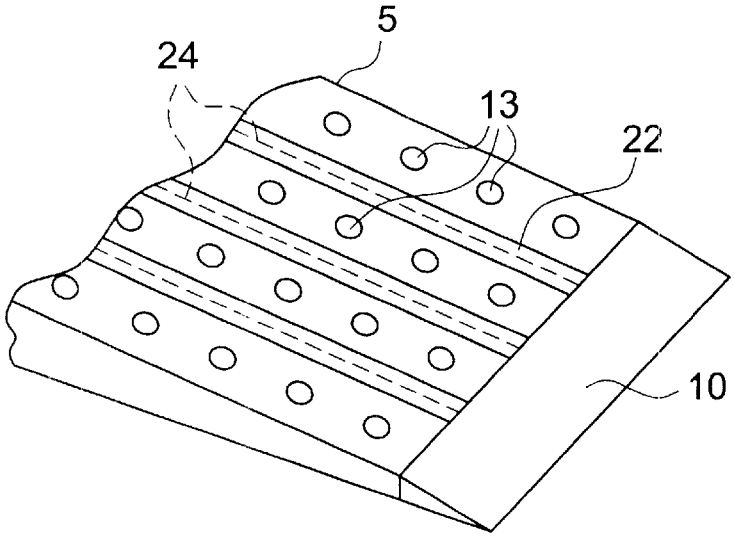
FIG. 3(*a*) is a perspective view of the front portion of one the sections of the present invention.
Figure 3B:
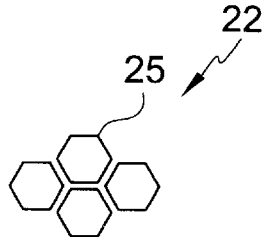

FIG. 3(*a*) is a perspective view of the front portion of one the ramp sections (5) of the present invention. Ramp section 5 is shown, however each of the ramp sections 5,7,9 have the same construction. The honeycomb structure for each of the individual units making up the fill material 22 is best shown in FIG. 3(*b*). The vertical cylinders 13 are shown in FIG. 3(*a*) as being located spaced in rows. The rows are generally parallel to each other. The forward leading metal edge strip 10 is also shown fixed to the front edge of section 5. The edge 10 is joined to the fill material 22 to provide a high impact resistant edge. Spaced steel rebars 24, shown in dotted line format, extend through and along most of the length of ramp sections 5,7,9. The surface of sections 5,7,9 comprises a layer of upper hardened rubber material made with individual honeycombed units. By orienting the rebars 24 in the direction of vehicle travel over the section 5, the impacted material will not curl up as traffic continuously passes over the section. Apertures extending the lengths of the ramp sections permit rebars to be inserted into the sections 5,7,9. Between the rebars 24 are the rows of cylinders 13. The lower ends of the lag bolts or concrete bolts, if desired, can be secured to the roadway in any conventional manner.

FIG. 3(*b*) is a top view showing four individual honeycombs units 25 that make up the fill material 22. By joining many such adjacent honeycombed units 25 together the fill material 22 is formed. Each individual honeycomb unit 25 is formed like a cylinder with an hexagorial cross section. When many cylinders 25 are oriented vertically and joined together, an extremely strong compression resistant structure is provided.

FIG. 4 is another top view showing the rebars 24 and honeycombed structures 25 of the transition device 1. Each ramp section 5,7,9 has the same construction. Fill material 22 comprising the individual honeycomb units 25 is located between rubber or plastic sleeves 28. The sleeves 28 have apertures along their lengths used to retain inserted rebars 24. Fill material 22 essentially fills the volume between the sleeves. The individual honeycomb units 25 may be made identical to each other in cross section, however, their heights may vary to accommodate different surface inclines. Thicker ramp end 26 (see FIG. 1) has apertures for inserting the sleeves 28 and their rebars 24 into the transition device 1. The upper surfaces of the ramp sections 5,7,9 normally have the same angle of incline which angle may vary to suit their intended use.

Figure 5:
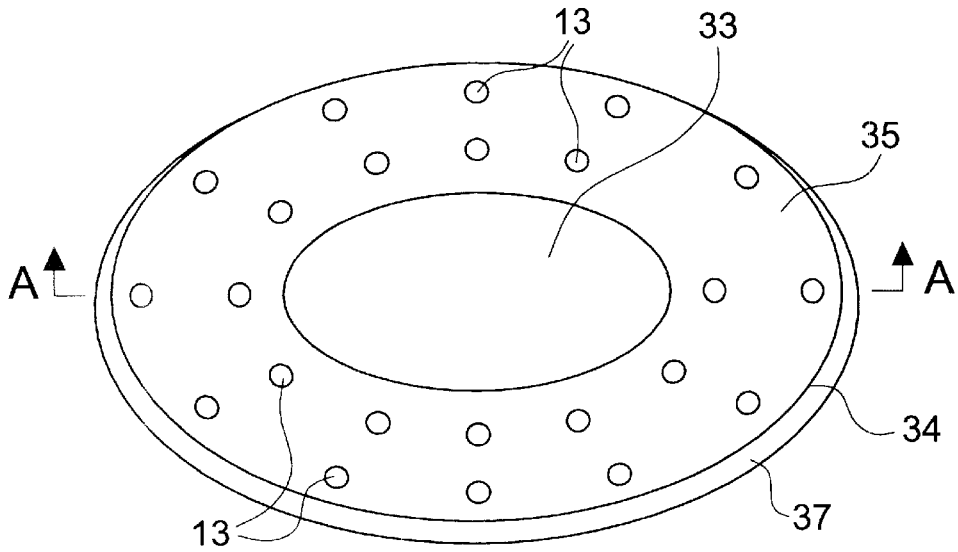
FIG. 5 is a perspective view of the present invention used with a manhole cover.

FIG. 5 is a perspective view of the present invention used with a manhole cover 33. The transition section 35 is positioned around the manhole cover 33. An opened center is formed by the transition device 35 to receive the manhole cover. The outer edges 34 of section 35 provide for a smooth upward transition from the lower roadway to meet with the top surface of the higher manhole cover 33. At lower edges 34 there is a hardened metal edge 37, similar to the edge 10 in FIG. 1. The ramp section 35 is internally constructed like the ramp sections 5,7,9 using cylinders 13, lag bolts, rebars in a honeycombed unit fill material.

Figure 6:
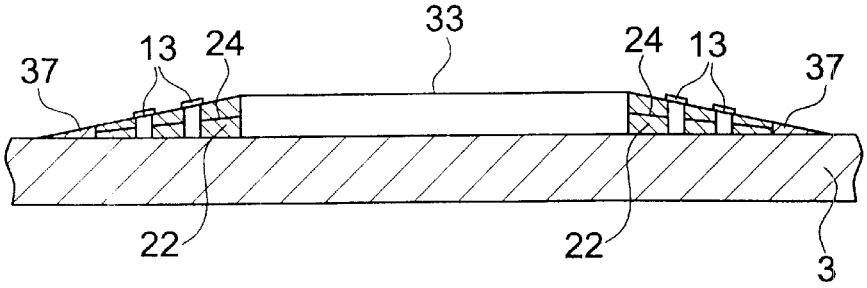
FIG. 6(*a*) is a side cross section taken along line A—A of the FIG. 5 showing the transition device around the manhole cover.
Figure 6:
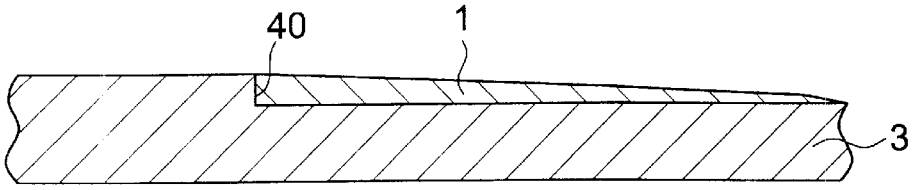

FIG. 6(*a*) is a side cross section taken along line A—A of the FIG. 5 showing the transition device 35 around the manhole cover 33. The roadway 3 extends below the transition device and manhole cover. Two cylinders 13 are shown on each side of the manhole cover 33. Behind the cylinders are rebars 24 in their sleeves (not shown). The rebars and their sleeves would be oriented like the spokes of a wheel around the manhole cover. The transition device fill material 22 extends to full up the space not occupied by the sleeves, rebars or cylinders.

FIG. 6(*b*) is a side cross section view of the FIG. 1 embodiment showing the transition device 1 on a roadway bump. A gradually upwardly slant is provide in device 1 to take into consideration the formed bump 40 in roadway 3. This interfacing of roadway bump and transition device allows for a smooth transition as a vehicle moves over the bump.

Figure 7:
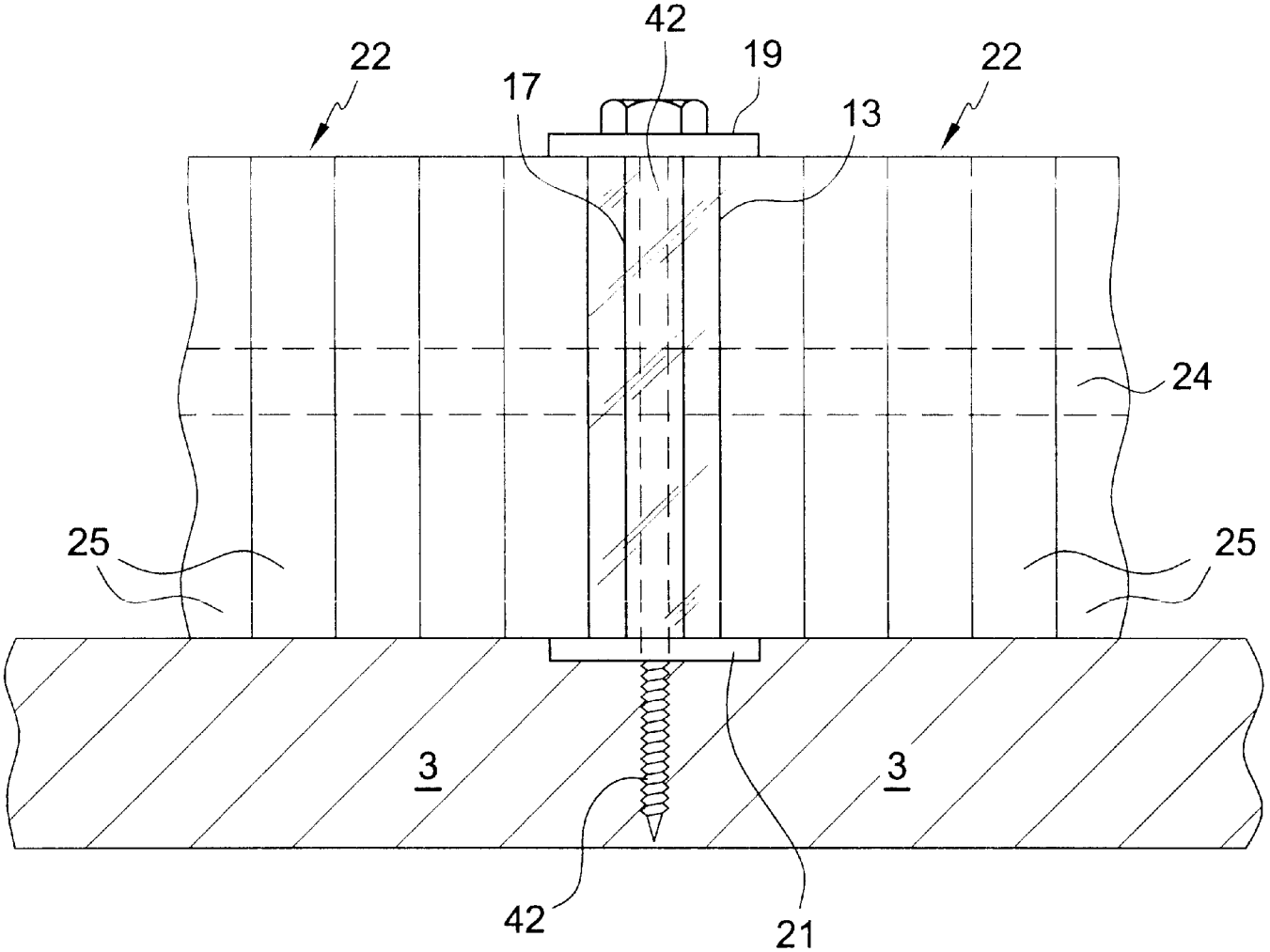
FIG. 7 is a side cross section view of the present invention showing the cylinder in fill material with a lag bolt extending through the cylinder into the ground.

FIG. 7 is a side cross section view of the present invention showing one of the cylinders 13 with adjacent fill material 22 and a lag bolt 42. The bolt 42 extends through the cylinder 13 into the lower ground or roadway 3. Cylinder 13 contains the lag bolt 42 within inner cylinder 17. The lower end of the lag bolt extends into the ground or roadway to secure the transition device. Behind the honeycomb structure making up the fill material 22 are the rebars 24 (one of which is shown in dotted line format). As seen. the rebars and their supporting sleeves are generally perpendicular to the height of the honeycombed structure units 25. The upper cylinder washer 19 engages the exposed head of the lag bolt 42 and the top of contacted units 25 while the lower washer 21 bears against the surface of the roadway 3 and the bottom of the units 25.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A transition device comprising:

a transition portion adapted to be placed on a roadway, said transition portion comprising at least one section, said at least one section having a length, thickness, a front edge, a top surface and a bottom surface, said bottom surface being adapted to be placed against a surface of a roadway, said at least one section having a hardened edge at the front edge, said at least one section including fill material, said fill material comprising separate honeycombed shaped cylinders oriented generally vertically and joined together, and strengthening members mounted along said fill material.

said strengthening members include a plurality of cylinders in said fill material which are vertically disposed, each of said plurality of cylinders being spaced from the other cylinders in the fill material.

2. The transition device as claimed in claim 1, wherein each of said plurality of cylinders has a bolt member vertically disposed in each cylinder, each of said bolt members being attached to an underlining roadway.

3. The transition device as claimed in claim 2, wherein said strengthening members include rebars inserted into the fill material that extend generally perpendicular to the honeycomb shaped cylinders.

4. The transition device as claimed in claim 2, wherein said at least one section has an upper surface inclined from horizontal.

5. The transition device as claimed in claim 1, wherein said inclined upper surface extends completely around an opened center.

* * * * *